US006502558B1

(12) United States Patent
Brunel

(10) Patent No.: US 6,502,558 B1
(45) Date of Patent: Jan. 7, 2003

(54) ASSEMBLY FOR TRANSFERRING FUEL FROM A MOTOR VEHICLE TANK

(75) Inventor: Daniel Brunel, Châlons-en-Champagne (FR)

(73) Assignee: Marwal Systems (FR)

( * ) Notice: Subject to any disclaimer, the term of this patent is extended or adjusted under 35 U.S.C. 154(b) by 0 days.

(21) Appl. No.: 09/701,441

(22) PCT Filed: May 25, 1999

(86) PCT No.: PCT/FR99/01216

§ 371 (c)(1),
(2), (4) Date: Nov. 22, 2000

(87) PCT Pub. No.: WO99/61777

PCT Pub. Date: Dec. 2, 1999

(30) Foreign Application Priority Data

May 26, 1998 (FR) ..... 98 06589

(51) Int. Cl.[7] ..... F02M 37/04
(52) U.S. Cl. ..... 123/509; 123/514
(58) Field of Search ..... 123/509, 510, 123/514, 497; 417/151; 210/411

(56) References Cited

U.S. PATENT DOCUMENTS 5,769,061 A * 6/1998 Nagata et al. ..... 123/509
5,782,223 A * 7/1998 Yamashita et al. ..... 123/510
6,213,726 B1 * 4/2001 Tuckey ..... 417/199.1

FOREIGN PATENT DOCUMENTS

| | | |
|---|---|---|
| DE | 9101313 | 4/1991 |
| DE | 1953568 | 3/1996 |
| FR | 798458 | 1/1997 |

* cited by examiner

*Primary Examiner*—Willis R. Wolfe
*Assistant Examiner*—Mahmoud Gimie
(74) *Attorney, Agent, or Firm*—Blakely Sokoloff Taylor & Zafman, LLP

(57) ABSTRACT

The present invention relates to a fuel-drawing assembly for a motor vehicle tank, the assembly comprising a main pump (110) associated with a pressure regulator (170) and a reserve bowl (150) fed by a jet pump (160) and from which the main pump (110) draws fuel, the assembly being characterized by the fact that the jet pump (160) is integrated in the outlet from the pressure regulator (170), and that the jet pump and regulator (160 and 170) subassembly formed in this way is secured to a module (100) comprising the main pump (110) and the reserve bowl (150), a portion of the housing (171) for the pressure regulator (170) being integrated in the wall constituting the reserve bowl (150).

27 Claims, 3 Drawing Sheets

ASSEMBLY FOR TRANSFERRING FUEL FROM A MOTOR VEHICLE TANK

FIELD OF THE INVENTION

The present invention relates to the field of assemblies for drawing fuel from a motor vehicle tank.

BACKGROUND OF THE INVENTION

Numerous devices have already been proposed for drawing fuel from a tank and directing the fuel to feed the engine (carburetor or injector).

Most known devices comprise an electric pump associated with a pressure regulator.

Devices are also known in which the electric pump draws from a reserve, commonly called the "reserve bowl" placed inside the fuel tank. Such a reserve bowl can be filled from the tank via a float valve which opens to allow fuel to pass from the tank into the reserve bowl whenever the level in the tank is higher than the level in the reserve bowl.

Various configurations have also been proposed comprising a jet pump or Venturi effect pump for feeding the reserve bowl. The jet pump is generally fed by an outlet stage of the main pump or by the outlet of the pressure regulator. It takes fuel in from the tank and its outlet delivers to the reserve bowl.

Document EP-A-0 798 458 describes a pump device designed to be immersed in a motor vehicle tank, said device comprising a main body in which two contiguous cavities are provided, the first cavity having its main opening at the top and containing a pumping sub-assembly, and the second cavity having its main opening on the side and containing a filter cartridge, said cavity being connected to a fixing plate via a duct to the duct of the plate in order to feed fuel to the vehicle, while a pressure regulator is disposed on the side of the cavity having the main opening and is associated with a jet-pump type system which opens out into the first cavity. (page 1, 1.22).

In conclusion, numerous fuel-drawing structures have already been proposed. Nevertheless, most of them are very complex and do not always give satisfaction.

SUMMARY OF THE INVENTION

An object of the present invention is to propose novel means for drawing fuel that present performance that is improved compared with known devices.

In one embodiment of the present invention, a fuel-drawing assembly for a motor vehicle tank comprises a main pump (110) associated with a pressure regulator (170) and a reserve bowl (150) fed by a jet pump (160) from which the main pump (110) draws fuel. The jet pump (160) is integrated in an outlet from the pressure regulator (170) to form a subassembly secured to a module (100) comprising the main pump (110) and the reserve bowl (150). A portion of a housing (171) for the pressure regulator (170) is integrated into a wall constituting the reserve bowl (150), and the outlet from the jet pump (160) is associated with means for degassing the fuel before it reaches the reserve bowl (150).

As explained below, the present invention makes it easier to adjust the jet/regulator pump subassembly compared with prior known dispositions.

By integrating these two components it is possible to adjust the pressure regulator in the factory. This adjustment thus makes it possible to take account of the downstream back pressure imposed on the regulator by the jet pump (which downstream back pressure can modify the characteristics of the regulator).

In addition, the structure proposed in the context of the present invention makes it possible to eliminate any need for sealing means to be fitted between the outlet of the pressure regulator and the inlet of the jet pump.

The invention also provides a motor vehicle fuel tank fitted with such a fuel-drawing assembly.

BRIEF DESCRIPTION OF THE DRAWINGS

Other characteristics, objects, and advantages of the present invention will appear on reading the following detailed description, made with reference to the accompanying drawings that are given by way of non-limiting examples and in which:

Accompanying FIG. 1 shows the general architecture of a fuel-drawing assembly of the present invention.

DETAILED DESCRIPTION OF THE INVENTION

Figure 1:
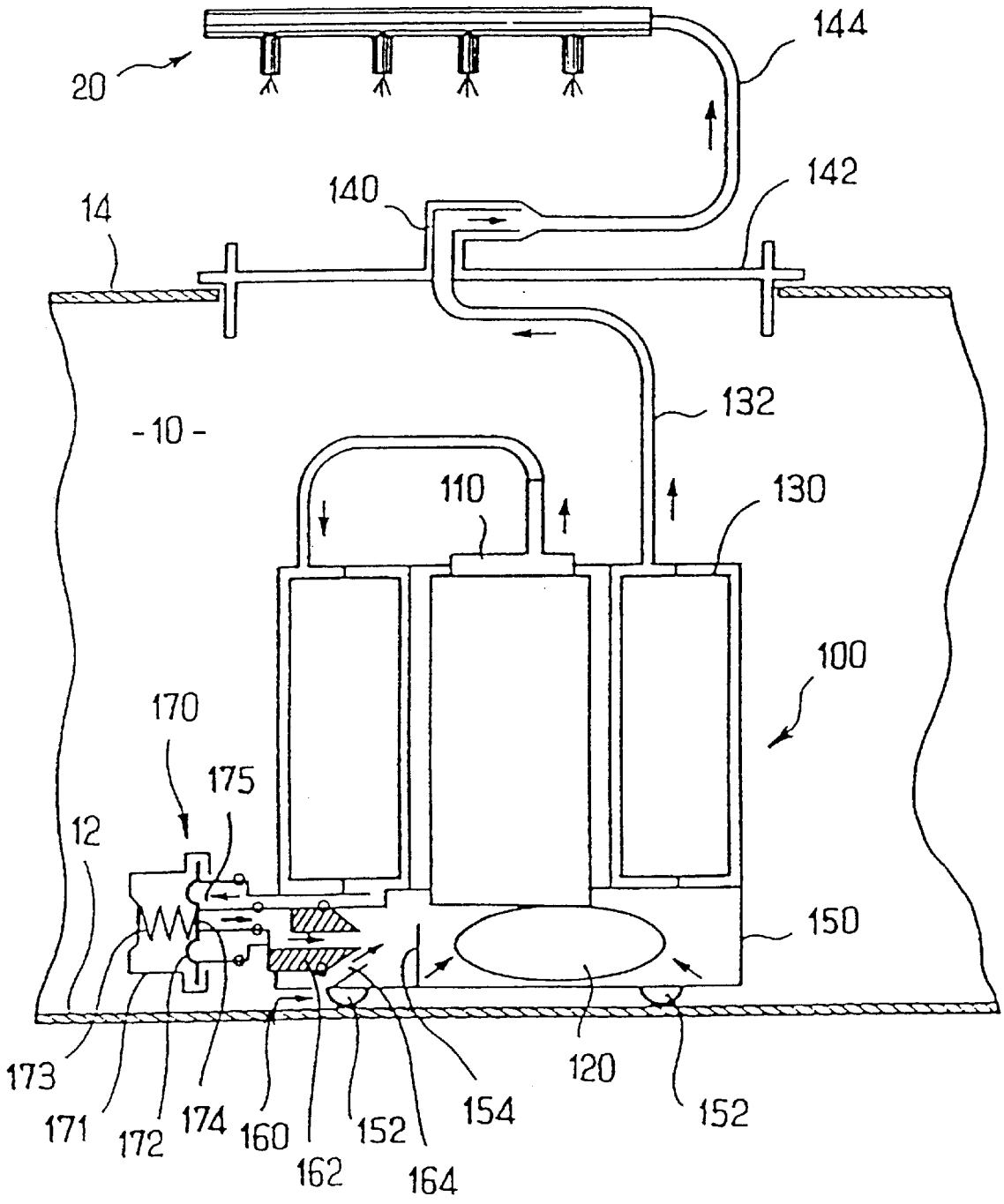
FIG. 1 is a diagrammatic view of the general architecture of a fuel-drawing device in accordance with the present invention.

In FIG. 1, there can be seen under general reference 10, a fuel tank whose bottom is referenced 12 and whose top wall is referenced 14.

A fuel-drawing module 100 is placed in the tank 10.

Essentially, this fuel-drawing module 100 comprises an electric pump 110, a primary filter 120, a secondary filter 130, a pressure regulator 170, and a jet pump 160.

The electric pump 110 has its axis extending vertically. Its inlet is connected to the primary filter 120 situated close to the bottom of the tank 10, and more precisely inside the reserve bowl 150 as described below.

The outlet from the electric pump 110 feeds into the secondary filter 130 which is constituted by a filter that is finer than the primary filter 120.

Thus, the fuel coming from the main pump 110 passes radially through the filter 130 from the outside towards the inside thereof (although the opposite disposition is possible, i.e. the outlet from the pump 110 can deliver to the inside of the filter 130, in which case the fuel passes through the filter radially towards the outside thereof).

From the outlet of the filter 130, the filtered fuel is directed via a duct 132 to a tubular fitting 140 carried by a base 142 for fixing on the top wall 14 of the tank. From there, the fuel is directed via a duct 144 to the injector assembly 20.

As mentioned above, the primary filter 120 from which the inlet of the pump 110 draws fuel is disposed in the reserve bowl 150. The bowl stands on the bottom wall of the tank 12 via short legs 152.

The reserve bowl 150 is designed to be filled by the jet pump 160 associated with the pressure regulator 170.

The pressure regulator 170 preferably possesses a housing 171 which receives a diaphragm 172. In the particular embodiment shown in FIG. 1, the inlet to the housing of the regulator 170 is connected to the outlet of the secondary filter 130.

The diaphragm 172 is subjected to the opposing forces from a rated spring 173 and from the pressure of the fuel that is applied via the inlet to the regulator 170.

The diaphragm 172 carries a shutter 174 associated with a fixed seat 175. Thus, when the fuel pressure is weaker than the force from the spring 173, the shutter 174 rests against the seat 175 and the regulator 170 is closed. The jet pump 160 is then not fed.

Conversely, when the fuel pressure on the inlet of the regulator 170 exceeds the force from the spring 173, the diaphragm 172 and the spring 173 are deformed. The shutter 174 is separated from its seat 175. Fuel can thus flow towards the outlet of the regulator 170 which communicates with the inlet of the jet pump 160.

More precisely still, the outlet from the regulator 170 communicates with the inlet of a nozzle 162.

The jet pump 160 also has a suction duct 164 which communicates with the bottom of the tank 10 and whose outlet opens out into the body of the jet pump 160 downstream from the nozzle 162.

The outlet from the jet pump 160 itself opens out into the inside of the bowl 150.

The outlet from the jet pump 160 is preferably associated with means enabling the fuel to be degassed before it reaches the reserve bowl 150.

As shown in FIG. 1, a low wall 154 can be provided facing the outlet from the jet pump 160. This wall 154 is connected in leakproof manner laterally and at its base to the walls forming the reserve bowl 150. Fuel coming from the jet pump 160 thus strikes the wall 154. As a result, any bubbles of air carried along with the fuel in the jet pump 160 are broken up. The fuel reaches the reserve bowl 150 proper by overflowing over the wall 154. The wall 154 thus defines the maximum level inside the reserve bowl 150 when it is not being fed by the jet pump 160.

In a variant, such a wall 154 can be replaced by a spiral with a rising bottom whose inlet is placed facing the outlet of the jet pump 160 and whose outlet opens out into the reserve bowl 150. Under such circumstances, the fuel is degassed progressively as it flows around the spiral.

In a variant embodiment, the inlet of the regulator 170 connected to the outlet of the fine secondary filter 130 in FIG. 1 could be connected upstream from the fine filter 130.

Figure 2:
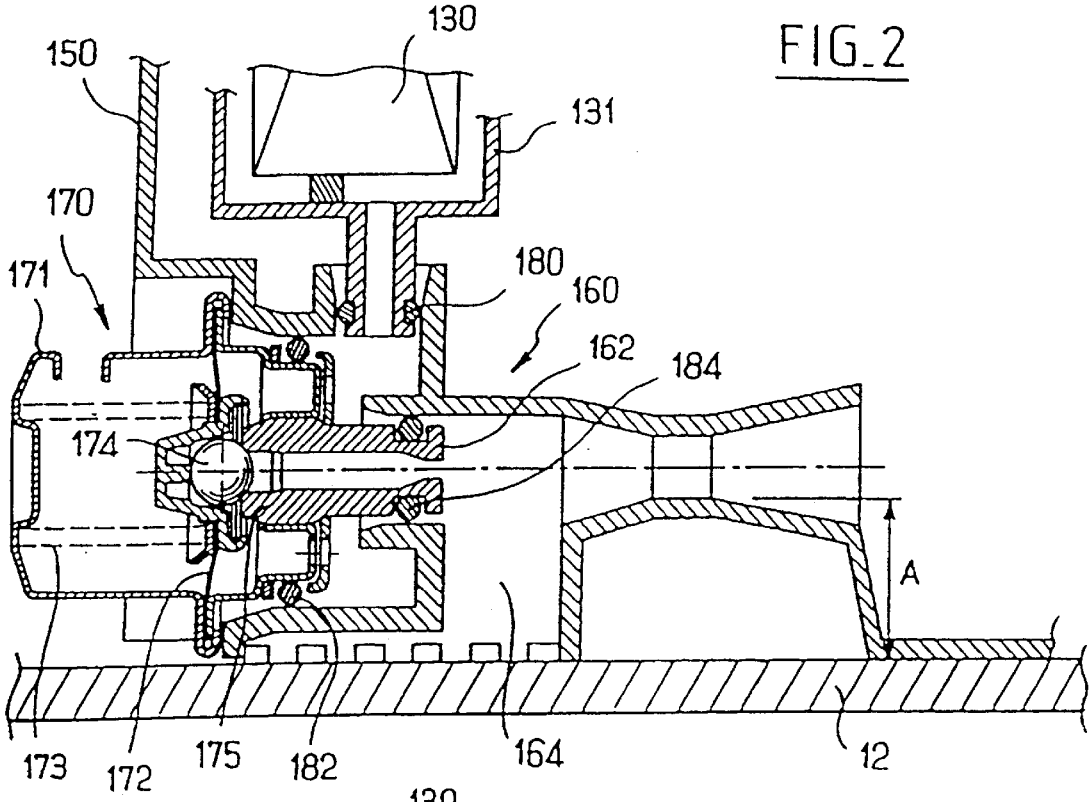
FIGS. 2 and 3 are diagrammatic vertical section views through two variant embodiments of an integrated pressure regulator and jet pump subassembly in accordance with the present invention.

FIG. 2 shows one way in which the pressure regulator 170 and the jet pump 160 can be integrated.

FIG. 2 shows the main wall of the reserve bowl 150, the fine secondary filter 130 disposed in a housing 131, the regulator 170 comprising a housing 171, a diaphragm 172 associated with a spring 173, and carrying a shutter 174 co-operating with a seat 175, and also the jet pump 160 having a nozzle 162 and a suction duct 164.

It will be observed that in the particular embodiment shown in FIG. 2, the shutter 174 carried by the diaphragm 172 is constituted by a spherical ball.

It will also be observed on examining FIG. 2 that the seat 175 and the nozzle 162 are formed at opposite ends of a single piece which is preferably made by turning.

In practice, the shape of the body of the jet pump 160 (converging portion, diverging portion) can be the subject of numerous variants depending on the characteristics desired for the pump.

For these reasons, the particular embodiment of the jet pump 160 shown in accompanying FIG. 2 is not described in detail below.

Nevertheless, it should also be observed that O-rings are present, particularly a first ring 180 between the outlet of the fine filter 130 and the wall of the bowl 150 communicating with the inlet of the pressure regulator 170, a second ring 182 between the housing 170 of the pressure regulator and the wall of the reserve bowl 150, and finally a third sealing ring 184 around the nozzle 162, between the nozzle and the body of the jet pump 160.

In the embodiment shown in FIG. 2, the jet pump 160 has its axis horizontal.

Figure 3:
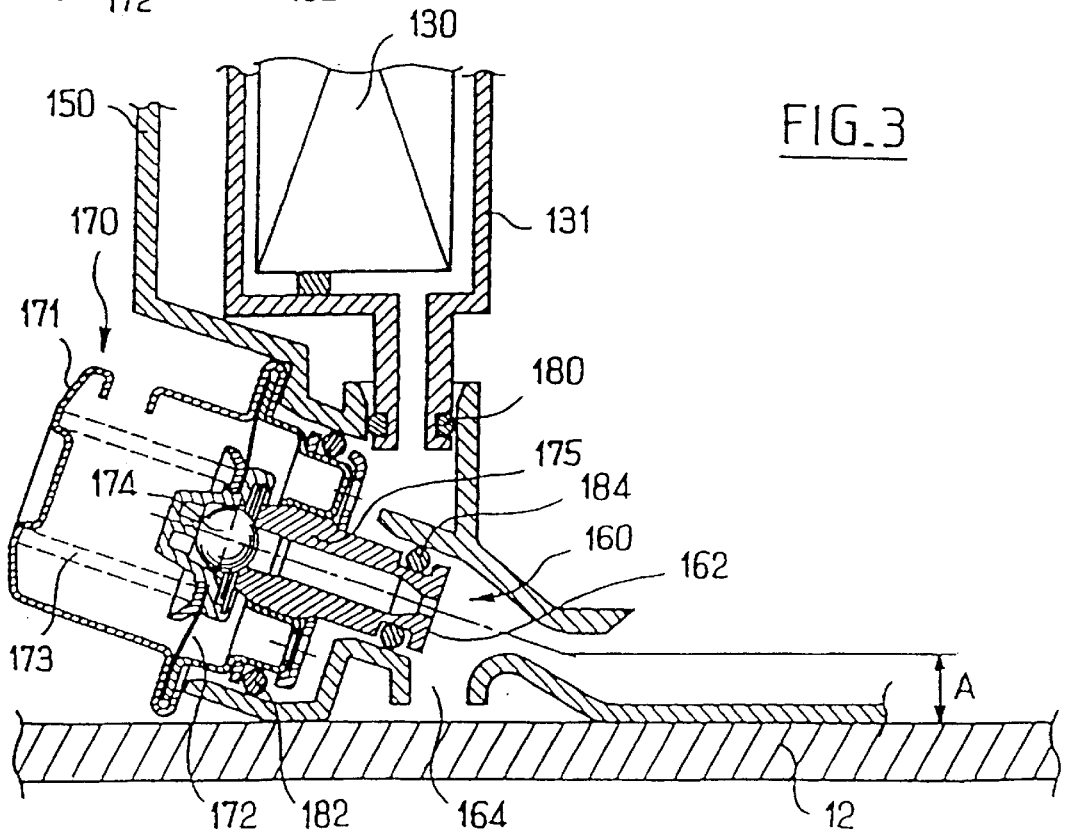

FIG. 3 shows a variant embodiment in which the pressure regulator 170 and the jet pump 160 are constituted by the same means as those shown in FIG. 2 and as descried above.

However, in the variant of FIG. 3, the jet pump 160 (and the regulator 170) has its axis at an angle to the horizontal, sloping down towards the bottom 12 of the tank on going towards the outlet from the nozzle 162.

This disposition makes it possible to reduce the suction and priming height of the jet pump 160.

In non-limiting manner, the axis of the jet pump 160 can thus typically be inclined at an angle of about 18° to the horizontal.

Typically, this disposition makes it possible to reduce the priming height of the jet pump 160 to a height A of about 6.4 mm for the embodiment shown in FIG. 3 compared with a priming height A of about 15.7 mm for the embodiment shown in FIG. 2.

According to another advantageous characteristic of the present invention, the jet pump 160 can have a nozzle of variable section.

By way of example, the jet pump can be one in which the nozzle which receives the injected flow is made up of a nozzle piece comprising a plurality of lips of resilient material adapted so that the nozzle piece presents a section that varies depending on the injected pressure and flow rate, as proposed by the Applicant in Applicant's patent application filed in France on Sep. 26, 1996 under the No. 96/11739.

Figure 4:
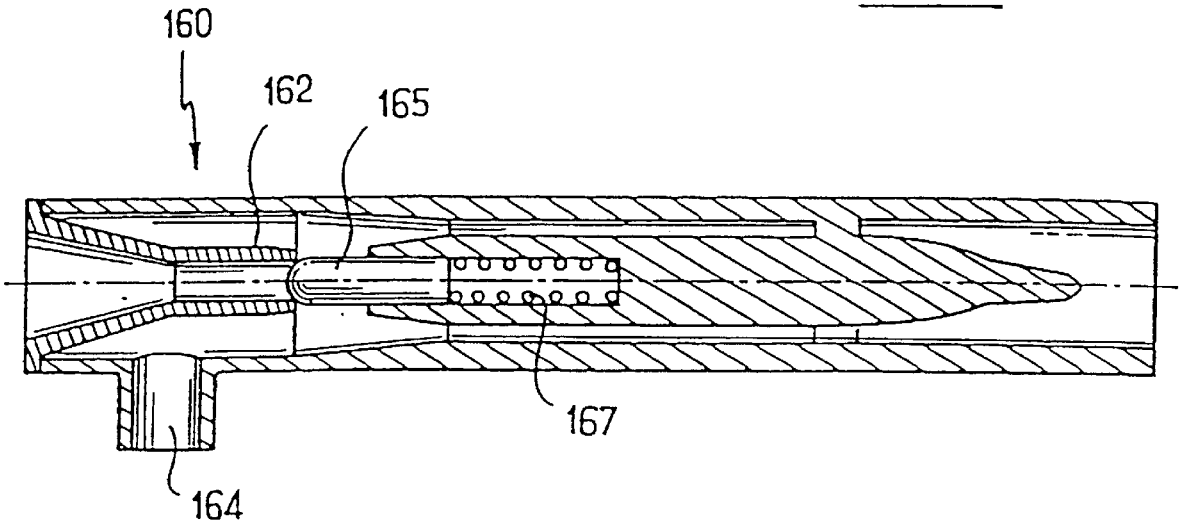
FIGS. 4 and 5 are diagrammatic vertical longitudinal section views of two variant embodiments of the jet pump in accordance with the present invention.
Figure 5:
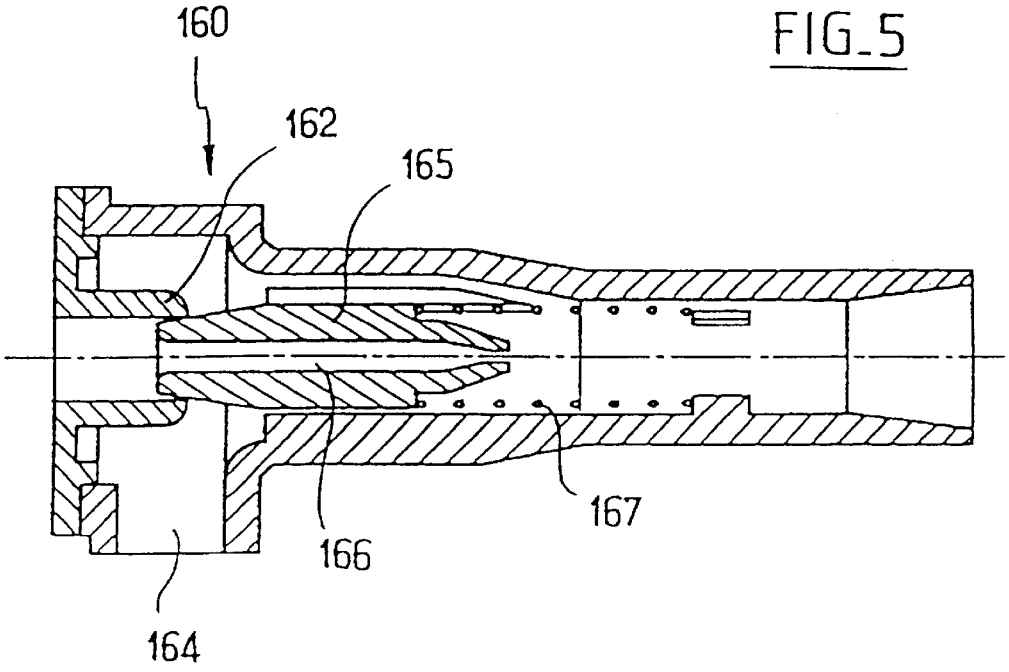

In another variant, as shown in FIGS. 4 and 5, the jet pump 160 can have a nozzle 162 and a core 165 mounted to move relative to the outlet nozzle piece of the nozzle 162, downstream therefrom.

In yet another variant, as shown in FIG. 5, the core 165 can be provided with a longitudinal through channel 166 forming an auxiliary nozzle.

The core 165 can be guided in translation along the axis of the jet pump 160 by any suitable known means. Naturally, these guide means must not disturb the flow of fuel from the nozzle 162 and suck into the suction duct 164.

It may be observed that the core 165 is urged towards the outlet of the nozzle 162 by a rated spring 167.

The core 165 preferably rests against the free end of the nozzle 162 which is in the form of a zone restricted substantially to a circular ridge or against a contact generator line defined on the nozzle 162.

Nevertheless, the particular shape of the end of the nozzle 162 and of the segment of the core 165 resting thereagainst can be the subject of numerous variant embodiments as described in a parallel patent application filed in the name of the Applicant. That is why those various embodiments and the detailed structure of the jet pump with a core shown in FIGS. 4 and 5 is not described in detail below.

The operation of the jet pump shown in FIG. 4 is essentially as follows.

At the lowest injected flow rates, the ejection section, i.e. the free section of the nozzle 162 is small which makes it possible to increase the power imparted to the jet pump by a high injection pressure.

At higher return flow rates, the core 165 is pushed away from the nozzle 162 against compression of the spring 167, thus increasing the outlet flow section of the nozzle 162 and limiting the back pressure upstream from the nozzle 162 to an acceptable level.

The operation of the jet pump shown in FIG. 5 is essentially as follows.

When the outlet flow rate from the pressure regulator 170 i.e. at the inlet of the jet pump 160 is zero, the same applies for the flow rate in the suction inlet 164 and for the flow rate at the outlet from the jet pump. Under such circumstances, the core 165 rests against the end of the nozzle 162.

When the flow rate injected into the inlet of the jet pump 160 from the outlet of the pressure regulator is low, the back pressure remains below the pressure threshold for opening the core 165 (as a function of the rating of the compression spring 167), thereby localizing injection through the auxiliary nozzle formed by the longitudinal channel 166 in the core 165. The Venturi effect is thus implemented in conventional manner and the transferred flow is collected via the mixer tube situated downstream from the core 165.

When the flow injected into the inlet of the pump increases, the back pressure rises above the pressure threshold and the core 165 moves back progressively deforming the spring 167 and releasing an annular flow section between the core 165 and the nozzle 162. This discharge serves to limit the increase of pressure above the opening threshold at high injected flow rates while guaranteeing a secondary Venturi effect at the outlet from the nozzle 162, thereby contributing to increasing the flow rate sucked in through the inlet 164 after the core 165 has backed off.

Thus, in first variant embodiment, provision can be made to use a portion of the wall of the reserve bowl in the form of a shell to form a portion of the housing 171 of the pressure regulator 170, or indeed to fit the housing 171 of a conventional pressure regulator inside a back piece formed by said wall of the reserve bowl 150.

It should be observed that the fuel-drawing assembly of the present invention is preferably also fitted with conventional means for gauging the level of fuel in the tank 10.

What is claimed is:

1. A fuel-drawing assembly for a motor vehicle tank, the assembly comprising:

a main pump (110) associated with a pressure regulator (170) and a reserve bowl (150) fed by a jet pump (160) from which the main pump (110) draws fuel, wherein the jet pump (160) is integrated in an outlet from the pressure regulator (170) to form a subassembly secured to a module (100) comprising the main pump (110) and the reserve bowl (150), a portion of a housing (171) for the pressure regulator (170) being integrated in a wall constituting the reserve bowl (150), and wherein the outlet from the jet pump (160) is associated with means for degassing the fuel before it reaches the reserve bowl (150).

2. The fuel-drawing assembly of claim 1, wherein the jet pump (160) includes a horizontal axis.

3. The fuel-drawing assembly of claim 1, wherein the jet pump (160) has an axis inclined relative to the horizontal, converging towards the bottom of a tank (10) when going towards the outlet of the nozzle (160) of the jet pump.

4. The fuel-drawing assembly of claim 1, further comprising:

a fine filter (130) associated with the outlet from the main pump (110).

5. The fuel-drawing assembly of claim 4, wherein the fine filter (130) is of the annular type and is disposed around the main pump (110).

6. The fuel-drawing assembly of claim 1, wherein the regulator (170) comprises a diaphragm (172) subjected to opposing forces, firstly from a rated spring (173) and secondly from the pressure of the fuel coming from the main pump (110).

7. The fuel-drawing assembly of claim 1, wherein the jet pump (160) comprises a nozzle (162) whose inlet is connected to the outlet of the pressure regulator (170) and by a suction duct (164) which communicates with the bottom of a tank (10) and which opens out into the body of the jet pump (160) downstream from the nozzle (162).

8. The fuel-drawing assembly of claim 1, wherein the jet pump (160) includes a shutter (174) constituted by a ball.

9. The fuel-drawing assembly of claim 1, wherein a seat (175) of the pressure regulator (170) and a nozzle (162) of the jet pump are formed at the ends of a common piece.

10. The fuel-drawing assembly of claim 1, wherein the jet pump (160) has a core (165) mounted to move relative to an outlet nozzle piece of a nozzle and downstream therefrom.

11. The fuel-drawing assembly of claim 10, wherein the core (165) is urged by a spring (167) against the outlet of the nozzle (162).

12. The fuel-drawing assembly of claim 10, wherein the core (165) is provided with a longitudinal through channel (166) forming an auxiliary nozzle.

13. The fuel-drawing assembly of claim 1, wherein the degassing means comprises a low wall (154) placed facing the outlet from the jet pump (160) and adapted to allow the reserve bowl (150) to be filled by overflowing.

14. The fuel-drawing assembly of claim 1, wherein the degassing means comprises a spiral.

15. A motor vehicle fuel tank comprising a fuel-drawing assembly according to claim 1.

16. A fuel-drawing assembly for a motor vehicle tank, the assembly comprising:

a main pump (110) associated with a pressure regulator (170) and a reserve bowl (150) fed by a jet pump (160), from which the main pump (110) draws fuel, wherein the jet pump (160) is integrated in an outlet from the pressure regulator (170) to form a subassembly secured to a module (100) comprising the main pump (110) and the reserve bowl (150), a portion of the housing (171) for the pressure regulator (170) being integrated in the wall constituting the reserve bowl (150), and wherein the outlet from the jet pump (160) is associated with means for degassing the fuel before it reaches the reserve bowl (150) the degassing means comprising a wall (154) placed facing the outlet from the jet pump (160) and adapted to allow the reserve bowl (150) to be filled by overflowing.

17. The fuel-drawing assembly of claim 16, wherein the jet pump (16) has a horizontal axis.

18. The fuel-drawing assembly of claim 16, wherein the jet pump (160) has an axis inclined relative to the horizontal, converging towards the bottom of a tank (10) when going towards the outlet of the nozzle (160) of the jet pump.

19. The fuel-drawing assembly of claim 16, wherein a fine filter (130) is associated with the outlet from the main pump (110).

20. The fuel-drawing assembly of claim 19, wherein the fine filter (130) is of the annular type and is disposed around the main pump (110).

21. The fuel-drawing assembly of claim 16, wherein the regulator (170) comprises a diaphragm (172) subjected to opposing forces, firstly from a rated spring (173) and secondly from the pressure of the fuel coming from the main pump (110).

22. The fuel-drawing assembly of claim 16, wherein the jet pump (160) comprises a nozzle (162) whose inlet is connected to the outlet of the pressure regulator (170) and by a suction duct (164) which communicates with the bottom of a tank (10) and which opens out into a body of the jet pump (160) downstream from the nozzle (162).

23. The fuel-drawing assembly of claim 16, wherein the jet pump (160) includes a shutter (174) constituted by a ball.

24. The fuel-drawing assembly of claim 16, wherein a seat (175) of the pressure regulator (170) and a nozzle (162) of the jet pump are formed at the ends of a common piece.

25. The fuel-drawing assembly of claim 16, wherein the jet pump (160) has a core (165) mounted to move relative to an outlet nozzle piece of a nozzle and downstream therefrom.

26. The fuel-drawing assembly of claim 25, wherein the core (165) is urged by a spring (167) against outlet of a nozzle (162).

27. The fuel-drawing assembly of claim 25, wherein the core (165) is provided with a longitudinal through channel (166) forming an auxiliary nozzle.

* * * * *